United States Patent [19]

Warshawsky

[11] Patent Number: 4,854,896

[45] Date of Patent: Aug. 8, 1989

[54] HEAVY-DUTY LAMP SOCKET

[76] Inventor: Jerome Warshawsky, 1322 Everitt Pl., Hewlett Harbor, N.Y. 11557

[21] Appl. No.: 6,174

[22] Filed: Jan. 23, 1987

[51] Int. Cl.[4] ..... H01R 17/04

[52] U.S. Cl. ..... 439/703; 439/753

[58] Field of Search ..... 439/332–337, 439/616, 644, 702–707, 753; 285/376, 401, 361, 396, 402

[56] References Cited

U.S. PATENT DOCUMENTS

| | | | |
|---|---|---|---|
| 939,036 | 11/1909 | Koper | 285/376 |
| 1,639,125 | 8/1927 | Benjamin | 439/319 |
| 1,771,636 | 7/1930 | Hubbell, Jr. | 439/753 |
| 1,774,014 | 8/1930 | Hubbell, Jr. | 439/753 |
| 1,901,205 | 3/1933 | Tregoning | 439/707 |
| 3,189,372 | 6/1965 | Johnson | 285/376 |
| 3,202,956 | 8/1965 | Hennessey, Jr. | 285/396 |

*Primary Examiner*—Gil Weidenfeld
*Assistant Examiner*—Gary F. Paumen
*Attorney, Agent, or Firm*—Stephen E. Feldman

[57] ABSTRACT

A socket shell for a lamp socket includes a substantially cylindrical socket sleeve formed to cooperate with a socket cap of substantially dome-shaped configuration and having a circumferential lip that seats up against an upper edge of said socket sleeve. Lugs are formed on the outer circumference of said socket sleeve proximate a first end thereof to pass through slots formed in the inner wall of said circumferential lip and to cooperate with said lip to obtain a releasable securing means. A thrust washer is deployed against a shoulder proximate said circumferential lip to apply pressure to said first end of said socket sleeve when attached to said socket cap so as to solidly lock said sleeve and cap in an assembled condition. The cap and sleeve are each formed of brass with a wall thickness of approximately 5/64ths of an inch to thus provide a heavy-duty lamp socket shell and lamp socket. The socket sleeve and cap are of a size and configuration to house an electrical unit which receives an incandescent light bulb and which includes electrical switch means to make and break an electrical circuit from the bulb to a source of power. The socket cap includes an opening to facilitate passage of an electrical conductor wire therethrough as well as connection thereto of a connector to facilitate connection of the socket to a lamp.

10 Claims, 2 Drawing Sheets

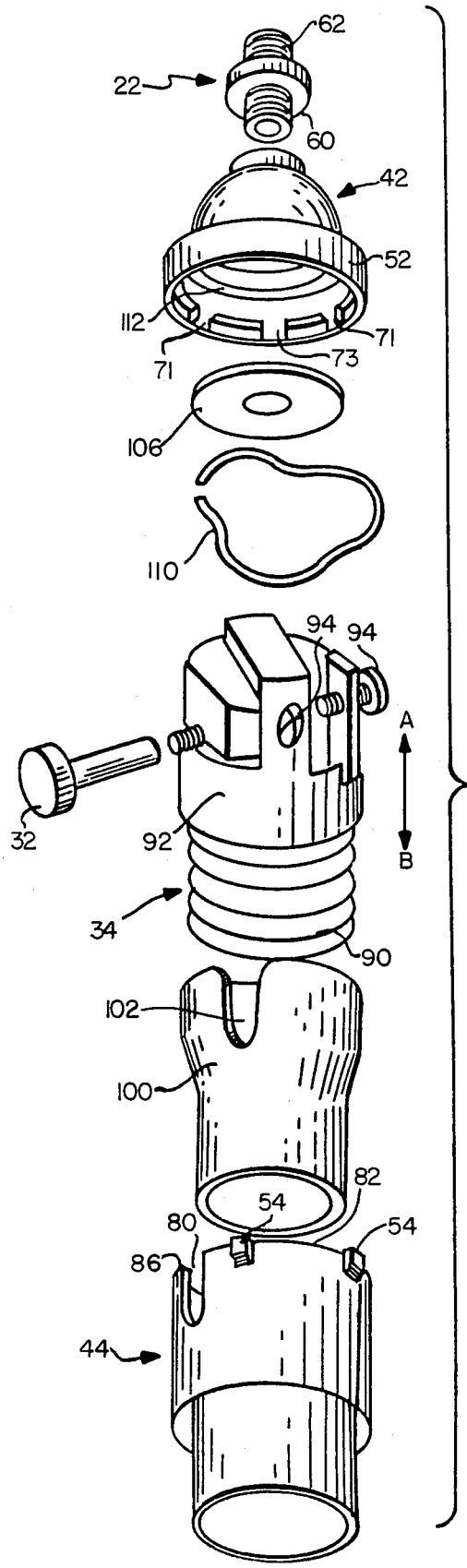
FIG. 3
FIG. 4
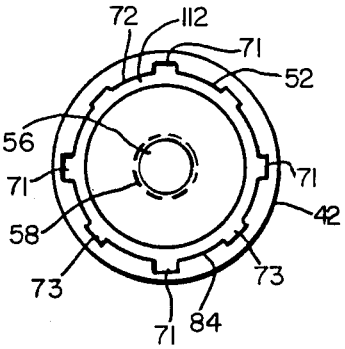
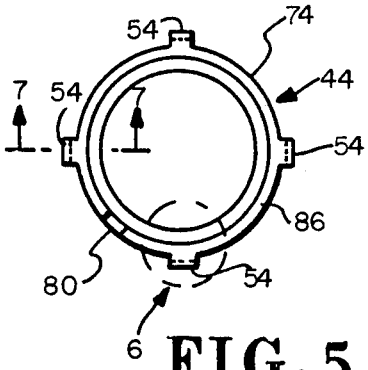
FIG. 5
FIG. 6
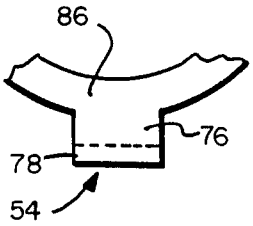
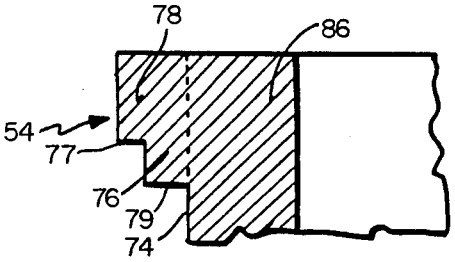
FIG. 7

HEAVY-DUTY LAMP SOCKET

BACKGROUND OF THE INVENTION-FIELD OF APPLICATION

This invention relates to lamp sockets and more particularly to heavy-duty lamp socket shells.

BACKGROUND FO THE INVENTION-DESCRIPTION OF THE PRIOR ART

A variety of sizes, shapes and designs of lamps are available. Lamps may be base mounted for disposition on a floor, table, desk or other item of furniture or support. Some lamps include a bracket or support for mounting ona wall or other vertically disposed member.

Most lamps include, as an essential element, a lamp socket in some form regardless of how the lamp is mounted, and what design elements are included to enhance the function and aesthetics of the lamp. Generally the socket used in a lamp incorporates the light bulb receiving unit, electrical connections for wiring the light bulb receiving unit for connection to a source of electricity, as well as some form of switching means (pull, twist, snap, remote etc.) for turning the lamp on and off.

A large percentage of such lamp sockets are constructed so that the electrical light bulb receiving member is unitized together with its switch and electrical connections so as to be easily placed within and removed from a socket shell which serves as a housing for the electrical unit. Cardboard or other suitable electrical insulation material, forms an insulating sleeve which usually serves to prevent contact between the wires, bulb holder and other electricity conducting members and the socket shell, which is usually made of meatl such as brass, aluminum or the like. Typically, a lamp socket shell also includes a threaded portion, or other suitable means, to mount the socket to its support pole, base, bracket or whatever. In this way the lamp socket shell constitutes a most important member of all lamps.

A cap and a sleeve, which are separable, are usually included in lamp socket shells to facilitate dispostiion within the shell of the electrical unit and the insulation member. This also facilitates wiring of the electrical unit for connection to a source of electrical power. Easily detachable detenting members (such as flutes and indentations) on contacting portions of the cap and sleeve are methods by which such caps and sleeves are almost invariably connected together. A form of retention, is thus provided between the cap and sleeve while permitting separation of the two members, usually by application of a screw driver blade to separate some of the flutes from the indentations, to permit wiring and rewiring of the electrical unit. Generally deformation of the sleeve and cap occurs with each separation of such a connection because the metal from which the members are formed is usually relatively thin. Also, the connection therebetween is weakened; sometimes to an extent which requires replacement of the lamp socket as a whole. Not only is the cost for a new socket involved but time and possibly expense for rewiring the new socket. Every one who owns a lamp may no necessarily be adept at wiring and otherwise replacing such lamp sockets. Therefore, the inability of the lamp socket parts to securely attach together to form a unit may result in damage. If the lamp socket sleeve and cap separate too easily the wiring for the electrical unit may become exposed and possibly disconnected. Exposed and disconnected wiring can cause electrical short circuits and electrical shocks if touched by someone attempting to operate the lamp.

Obviously, handling of the lamp socket is also required whenever the bulb has to be replace.d Invariably the lamp socket is also grasped or otherwise touched each time such a lamp is turned on or off. This is necessary when the electrical unit, incorporated into the lamp socket, includes a switch such as a twist action, snap type or the like. Any touch might loosen the socket sleeve and cap connection or otherwise distort the shape of the sleeve because for most lamp sockets, these parts are fabricated from relatively thin metal.

Some available lamp sockets, such as shown in U.S. Pat. No. 1,159,346 issued on Nov. 9, 1915 to L.W. Anderson for *Socket-Shell,* form the respective sleeve and cap with crimps and notches which are supposed to be deployed to prevent unwanted rotary movement between the parts. In use such crimps and notches may also inhibit ready assembly and disassembly of the socket; especially for the novice and unexperienced. The described socket-shell construction would seem to result in a relatively complex and expensive manufacturing cost for an item which is otherwise quite simple.

Other available lamp sockets, such as shown in U.S. Pat. No. 2,116,518 issued on May 10, 1938 to H. Hubbell, Jr. for *Reinforcing Jacket For Socket Shells.* dictates the use of separate and distinct jacket and ring members that are fitted over the socket cap and socket sleeve of a lamp socket. The number of parts that must be manufactured and inventoried to provided a unitary lamp socket of such construction thus obviously adds to the cost of the lamp socket. The resulting socket also seems to be more bulky in appearance. Additionally, there is no question but that the separation of the socket members, to facilitate wiring and rewiring and the reassembly thereof has been made more complex and time consuming by such a construction. Furthermore, the reinforcing jacket and ring must first be separated before the socket sleeve and cap of the socket shell can be separated, and then such members will have to be reassembled before the lamp socket is again usable.

SUMMARY OF THE INVENTION

It is therefore an object of this invention to provide a new and improved lamp socket.

It is another object of this invention to provide a new and improved socket shell for a lamp socket.

It is yet another object of this invention to provide a new and improved heavy-duty lamp socket.

It is yet still another object of this invention to provide a new and improved heavy-duty socket shell for a lamp socket.

It is a further object of this invention to provide a new and improved lamp socket shell wherein the lamp socket shell parts are fabricated from relatively heavy metal stock.

It is yet still a further object of this invention to provide a new and improved lamp socket shell wherein the socket shell cap and socket shell sleeve are releasably secured together.

This invention involves lamp sockets and contemplates forming the lamp socket shell of relatively heavy materials; and forming the socket shell cap and socket shell sleeve for relatively ready and repeated attachment to each other and separation from each other by cooperation of slots and a lip in the cap and lugs on the sleeve.

Other objects, features, and advantages of the invention in its details of construction and arrangement of parts will be seen from the above, from the following description of the preferred embodiment when considered with the drawing and from the appended claims.

BRIEF DESCRIPTION OF THE DRAWING

FIG. 3 is an exploded perspective view of the lamp socket of FIG. 1 cut away in part to better show details thereof;

FIG. 4 is an enlarged end view of the socket cap looking into the bottom;

FIG. 5 is an enlarged end view of the socket sleeve looking downward;

FIG. 6 is an enlargement of the circled portion of FIG. 5;

FIG. 7 is an enlarged sectional view taken on line 7—7 of FIG. 5; and

DESCRIPTION OF THE PREFERRED EMBODIMENT

For convenience, the invention will be described as applied to a base mounted table lamp incorporating a lamp socket having its socket shell formed from brass and housing an electrical unit with a built in twist switch. It should be understood, nevertheless, that without departing from the scope of the invention: that the lamp may be floor, wall or otherwise mounted; that the lamp socket parts may be formed of other suitable materials; and that the electrical unit may incorporate an otherwise actuated switch either direct or remotely operated.

Figure 1:
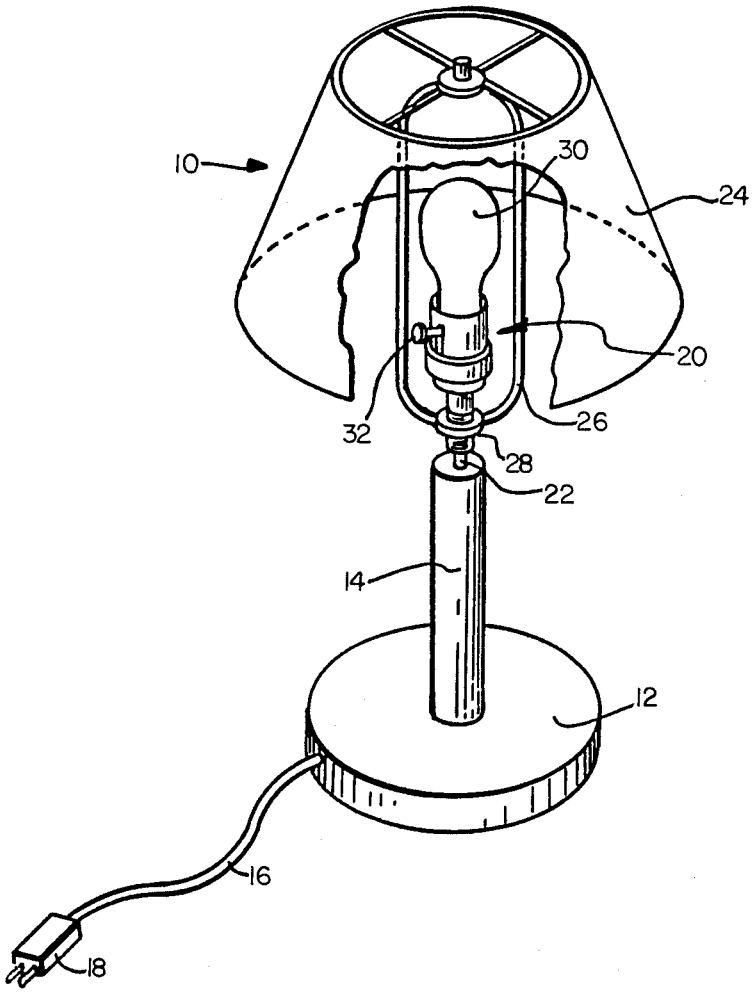
FIG. 1 is a schematic perspective view of a lamp with a lamp socket incorporating the instant invention.

With reference to FIG. 1, there is generally shown at 10 a lamp having a base 12 and a support post 14 sized to facilitate placement of lamp 10 upon a table, dresser, desk or other unit of home or office furniture (not shown). An electrical cord 16 has a plug 18 suitably connected to one of its ends to enable connection thereof to a suitable source of electrical power. The other end of electrical conductor 16 extends up through support post 14 and is electrically connected to a lamp socket 20 suitably mounted on top of support post 14 by an externally threaded connecting member 22 threaded into lamp socket 20 and support post 14. A lamp shade 24, carried by a harp 26 or other appropriate unit mounted to support post 14 and positioned by a set of nuts 28 or other conventional and suitable means, serves to shade and difuse the light when emitted by a conventional incandescent bulb 30 disposed in lamp socket 20. Lamp socket 20 incorporates a twist type on/off switch and actuator 32 for completing the electrical connection through an electrical unit 34 to bulb 30 in a conventional manner.

Figure 2:
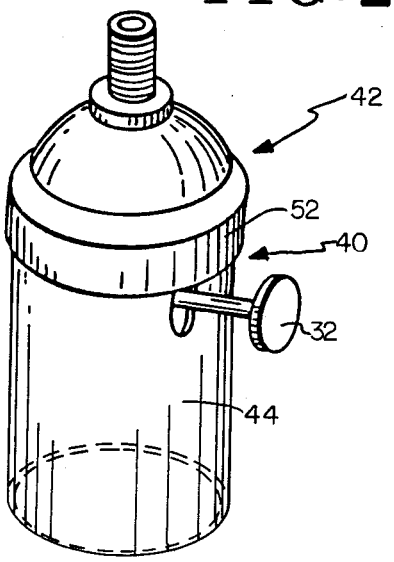
FIG. 2 is an enlarged perspective view of the lamp socket removed from the lamp of FIG. 1.

Lamp socket 20 (FIGS. 1-3) includes a socket shell 40 which incorporates a socket cap 42, and a socket sleeve 44. Cap 42 is relativey dome shaped in configuration with a lower circumferential lip 52 (FIGS. 2, 3 and 4) disposed for cooperation with a circumferential set of lugs 54 (FIGS. 3 and 5) formed at the upper extremity of sleeve 44. An opening 56 (FIG. 4) is formed in the upper portion of cap 42 and is internally threaded at 58 to receive a first set of external threads 60 (FIG. 3) formed on threaded connecting member 22. A second set of external threads 62 formed on connecting member 22 serve to connect member 22, and lamp socket 20, to support post 14 oflamp 10.

A first set of slots 71 (FIGS. 3 and 4) and a second set of slots 73 are essentially equally spaced, from each other and around the inner circumference of an inside circumferential wall 72 of lip 52 of cap 42. Slots 71 and 73 are milled, broached or otherwise formed to extend radially into wall 72 to a predetermined radial depth and so as to cooperate with lugs 54 as will be hereinafter described. Lugs 54 are milled, broached, turned or otherwise formed to extend radially outward from an outside circumferential wall 74 of sleeve 44 and to be spaced thereabout for cooperation with slots 71, 73.

Figure 8:
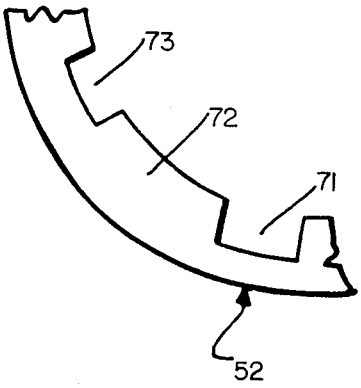
FIG. 8 is an enlarged plan view of a portion of the inner circumferential wall of the socket cap of FIG. 4.

There are as many slots 71 as there are of slots 73 and, in the embodiment shown, a similar number of cooperating lugs 54. It should be understood that more or less slots and lugs may be utilized. Slots 71 and 73 extend the entire axial extent of wall 72 from a lower edge thereof through an upper edge thereof. Slots 71 are, however, formed into wall 72 to a greater radial depth then slots 73 (FIG. 8). This construction of slots 71 and 73 is to accommodate the configuration of lugs 54 each of which is identical in arcuate extent and overall axial dimension but each of which includes a first lug portion 76 and a second lug portion 78 which meet a radial shoulder 77. A further radial shoulder 79 defines the lower extremity of lugs 54. Lug portions 78 extend out from sleeve 44 a radial distance which is greater than the radial distance that lug portions 76 extend out from sleeve 44.

Slots 71 and 73 are arcuately sized to permit the arcuate size of lugs 54 to pass through the slots. Slots 71 are, furthermore, sized to a radial depth to permit the radial extent of lug portions 78 to pass through slots 71. However, slots 73 are of a radial size that will not permit passage therethrough of lug portions 78 but, as will be hereinafter explained, which will receive lug portions 76 of lugs 54.

An elongated slot 80 is formed in sleeve 44 extending down a predetermined distance from upper end 82 thereof to accommodate on/off switch actuator 32 of electrical unit 34 when housed within socket shell 40.

Socket cap 42 and socket sleeve 44 are formed from brass. However, other suitable metals may be used. It is important to note that the metal from which cap 42 and sleeve 44 are formed is of relatively substantial thickness to provide for a sturdy and heavy duty socket shell 40 and lamp socket 20. for example, wall 84 of cap 42 and wall 86 of sleeve 44, are in the preferred embodiment formed from emtal having a thickness of approximately 5/64ths of an inch.

Socket shell 40 houses electrical unit 34 which includes a light bulb receiving socket 90 (FIG. 3), of conventional construction, and an electrical switch unit 92 that serves to make and break the electrical circuit between conductor 16 and bulb socket 90. Switch unit 92 is electrically connected to conductor 16 by a pair of connecting screws 94 and is operated by twist type actuator 32.

An insulating sleeve 100, of cardboard or other suitable insulating material is of a size and configuration to slip between electrical unit 34 and socket sleeve 44 when unit 34 is disposed within socket shell 40. An elongated opening 102 is formed in insulating sleeve 100 to correspond to and align with opening 80 in socket sleeve 44. An insulating cap 106,also formed from cardboard or other suitable insulating material is formed to a size and configuration to fit inside the dome portion of socket cap 42 to form an insulation barrier between the upper portion of electrical unit 34 and the ends of conductor 16 when connected thereto, and socket cap 42.

A thrust washer 110, of spring steel or other suitable spring material is of a predetermined size and configuration to fit within cap 42 and cooperate with top surface 86 of sleeve 44 and a surface 112 of cap 42.

To assemble socket 20 one need only insert insulation sleeve 100 into socket sleeve 44 with opening 102 of sleeve 100 aligned with opening 80 of sleeve 44. Electrical unit 34 is then slid into insulation sleeve 100 with switch on/off actuator 32 extending out through aligned openings 102, 80. The lowe walls of the material of sleeve 100 and 44 at openings 102, 80 is engaged by on/off switch actuator 32 and prevents electrical unit 92 from dropping through socket shell 40. Insulation cap 106 and washer 110 are inserted within socket cap 42.

Lugs 54 are aligned with and then slid in the direction of arrow A (FIG. 3) into the first set of slots 71 until wall 86 of sleeve 44 engages thrust washer 110. Further movement of sleeve 44 is against the bias of thrust washer 110 depressing same until shoulder 79 of lugs 54 pass through slots 71. Sleeve 44 may thereafter be rotated clockwise or counter-clockwise until lugs 54 align with slots 73. Relaxation of force against the bias of thrust washer 110 permits same to move sleeve 44 in the direction of arrow B so that first portions 76 of lugs 54 enter second set of slots 73. Second portions 78 of lugs 54 cannot, however, due to their radial size pass through slots 73 and thus locking sleeve 44 and cap 42 are locked together.

Prior to assembling cap 42 to sleeve 44 the ends of electrical conductor 16 should be inserted through the opening at the top of cap 42 and through an aligned opening of insulation cap 106. The wire ends should then be properly connected to connecting screws 94 of switch unit 34.

If it is desired to rewire lamp socket 20 or if lamp socket 20 has not been wired prior to being assembled it is relatively easy to disassemble same for wiring; or for other purposes. One need only push sleeve 44 in the direction of arrow A (FIG. 3) against the bias of washer 110 until lugs portions 76 slide out of slots 73. Either sleeve 44 of cap 42 may then be rotated to align lugs 54 with slots 71 and thereafter socket cap 42 and socket sleeve 44 may be separated. Electrical unit 34 may thereafter be lifted out of sleeve 44 all the way or sufficiently to provide access to connecting screws 94. After electrical unit 34 is wired, or rewired, socket shell 40 may be reassembled as hereinabove described.

From the above description it will thus be seen that there has been provided a novel and improved lamp socket, lamp socket shell and lamp socket cap whichis relatively simple in construction, has parts which can be firmly secured and assembled and disassembled, and is of heavy-duty construction to withstand the abuses and uses for which the lamp socket is to be put to.

It is understood that although I have shown the preferred form of my invention that various modifications may be made in the details thereof without departing from the spirit as comprehended by the followign claims.

What is claimed is:

1. A lamp socket comprising:

(a) socket sleeve means of substantially cylindrical configuration and having a first end and a second end;

(b) lug means formed on an outer circumference of said first end of said socket sleeve means and proximate said first end of said socket sleeve means;

(c) socket cap means substantially dome-shaped in configuration and having a first dome end and a second end with an central opening formed at said first dome end, a circumferential lip formed around said second end sized to align with said first end of said socket sleeve means and an internal circumferential shoulder above said circumferential lip;

(d) slot means formed in an inner wall of said circumferential lip of said socket cap means;

(e) electrical means formed to receive an electrical bulb and incorporating electrical switch means and of a size and configuration to be received within said socket sleeve means; and (f) a thrust washer of a predetermined diameter for coaction with said internal circumferential shoulder and said first end of said socket sleeve means;

said slot means including a first plurality of slots of a first radial size and evenly radially spaced and a second plurality of slots of a second smaller radial size and evenly spaced between said first plurality of slots, each lug having a firs radial portion sized to pass through said first plurality of slots but not through said second plurality of slots and a second radial portion saized to pass through said second plurality of slots; and said lug means of said socket sleeve means passing through said slot means and cooperating with said circumferential lip to form therewith a releasable securing means for releasably securing said socket cap means and said socket sleeve means together.

2. The lamp socket of claim 1, wherein said lugs are passed through said first plurality of slots and said socket sleeve means and socket cap means are rotated with respect to each other a predetermined distance to lock said socket sleeve means and socket cap means together.

3. The lamp socket of claim 2, wherein said socket cap means and socket sleeve means are so rotated with respect to each other said plurality of lugs align with said second plurality of slots and said second radial portions of said lugs are moved into said second plurality of slots to lock said socket sleeve means and socket cap means together.

4. The lamp socket of cliam 3, wherein said socket sleeve means and said socket cap means are brass.

5. The lamp socket of claim 4, wherein said socket sleeve means and said socket cap means have a relatively thick wall size is at least 5/64ths of an inch in thickness.

6. The lamp socket of claim 5, wherein said electrical means includes switch actuation means extending outwardly thereform and said socket sleeve means includes an elongated slot to receive said switch actuation means.

7. The lamp socket of claim 6, wherein said electrical means includes an insulation sleeve sized and of a configuration to be disposed between said socket sleeve means and said electrical means is disposed within said socket sleeve means, and insulation cap means sized and of a configuration to be disposed within said socket cap means.

8. A lamp socket comprising:

(a) socket sleeve means of substantially cylindrical configuration and predetermined diameter and having a first end and a second end;

(b) lug means formed on an outer circumference of said first end of said socket sleeve means fo a predetermined size and configuration and proximate said first end of said socket sleeve means;

(c) socket cap means substantially dome-shaped in configuration and having a first end and a second end with an opening formed at said first end and a circumferential lip formed around said second end and szied to align with said first end of said socket sleeve means;

(d) slot means fomed in an inner wall of said circumferential lip of said socket cap means;

(e) a thrust washer of a predetermined diameter for coaction with a shoulder deployed in said socket cap means and said first end of said socket sleeve means;

(f) said lug means of said socket sleeve means passing through said slot means and cooperating with said circumferentail lip to form therewith a releasable securing means for releasably securing said socket cap means and said socket sleeve means together.

9. The lamp socket of claim 8, wherein said lug means includes a plurality of lugs and said slot means includes a plurality of slots.

10. The lamp socket of claim 9, wherein said slot means includes a first plurality of slots of a first radial size and a second plurality of slots of a second radial size and each lug includes a first radial portion sized to pass through said first plurality of slots but not through said second plurality of slots and a second radial portion sized to pass through said second plurality of slots.

* * * * *